US010006589B2

(12) United States Patent
Rummelhoff

(10) Patent No.: US 10,006,589 B2
(45) Date of Patent: Jun. 26, 2018

(54) METHOD AND SYSTEM FOR STORAGE AND TRANSPORT OF LIQUEFIED PETROLEUM GASES

(71) Applicant: WÄRTSILÄ OIL & GAS SYSTEMS AS, Asker (NO)

(72) Inventor: Carl Jørgen Rummelhoff, Moss (NO)

(73) Assignee: WÄRTSILÄ OIL & GAS SYSTEMS AS, Asker (NO)

( * ) Notice: Subject to any disclaimer, the term of this patent is extended or adjusted under 35 U.S.C. 154(b) by 0 days. days.

(21) Appl. No.: 15/084,279

(22) Filed: Mar. 29, 2016

(65) Prior Publication Data

US 2016/0281929 A1 Sep. 29, 2016

Related U.S. Application Data

(62) Division of application No. 13/143,023, filed as application No. PCT/NO2010/000166 on May 3, 2010.

(30) Foreign Application Priority Data

Jun. 30, 2009 (NO) ..... 20092477

(51) Int. Cl.
*F25J 1/00* (2006.01)
*F17C 9/02* (2006.01)
(Continued)

(52) U.S. Cl.
CPC ..... *F17C 9/02* (2013.01); *F17C 13/004* (2013.01); *F25J 1/0025* (2013.01); *F25J 1/0236* (2013.01);
(Continued)

(58) Field of Classification Search
CPC ..... F25J 1/0022; F25J 1/0025; F25J 1/0271; F25J 2210/62; F25J 2210/90; F25J 2245/90; F25J 2245/0087
See application file for complete search history.

(56) References Cited

U.S. PATENT DOCUMENTS 3,011,321 A * 12/1961 Clauson ..... B63B 25/08 114/74 A
3,114,344 A 12/1963 Meade
(Continued)

FOREIGN PATENT DOCUMENTS

CN 101118077 A 2/2008
DE 3225300 A1 1/1984
(Continued)

OTHER PUBLICATIONS

Final Office Action received for U.S. Appl. No. 13/143,023, dated Dec. 31, 2014, 10 pages.
(Continued)

*Primary Examiner* — Brian King
(74) *Attorney, Agent, or Firm* — Morrison & Foerster LLP

(57) ABSTRACT

A method for storage and transport of LPG on LPG carriers, in particular two cargoes of different LPG types on same shipment, having reliquefaction units in which vaporized gases are condensed and then returned into at least one cargo tank for the respective LPG cargo type. The method is further comprising: using the reliquefaction units, at a minimum one running, as to condense vapor from the first cargo type; passing the condensed vapor through a heat exchanger; simultaneously flowing vapor from the second cargo type through the heat exchanger as to condense vapor by means of heat exchanging with the condensed vapor; and returning the condensed vapors leaving the heat exchanger back into
(Continued)

the respective cargo types. The present invention is also disclosing a system for storage and transport of LPG on LPG carriers.

4 Claims, 8 Drawing Sheets

(51) Int. Cl.
*F17C 13/00* (2006.01)
*F25J 1/02* (2006.01)

(52) U.S. Cl.
CPC ..... *F25J 1/0271* (2013.01); *F25J 1/0277* (2013.01); *F17C 2205/013* (2013.01); *F17C 2205/0338* (2013.01); *F17C 2221/035* (2013.01); *F17C 2223/0153* (2013.01); *F17C 2227/0135* (2013.01); *F17C 2227/0157* (2013.01); *F17C 2227/0164* (2013.01); *F17C 2227/0339* (2013.01); *F17C 2227/0341* (2013.01); *F17C 2227/0351* (2013.01); *F17C 2227/0388* (2013.01); *F17C 2250/01* (2013.01); *F17C 2260/013* (2013.01); *F17C 2265/017* (2013.01); *F17C 2265/034* (2013.01); *F17C 2270/0105* (2013.01); *F25J 2215/64* (2013.01); *F25J 2215/66* (2013.01); *F25J 2290/62* (2013.01)

(56) References Cited

U.S. PATENT DOCUMENTS

| | | | | |
|---|---|---|---|---|
| 3,857,145 | A | 12/1974 | Yamaguchi et al. | |
| 3,857,245 | A | 12/1974 | Jones et al. | |
| 3,857,251 | A * | 12/1974 | Alleaume | F17C 9/04 62/47.1 |
| 6,269,656 | B1 * | 8/2001 | Johnston | F25J 1/0022 62/611 |
| 6,530,241 | B2 | 3/2003 | Pozivil | |
| 2001/0042377 | A1 | 11/2001 | Pozivil | |
| 2003/0033809 | A1 * | 2/2003 | Konezciny | F02C 6/16 60/772 |

FOREIGN PATENT DOCUMENTS

| | | | |
|---|---|---|---|
| GB | 1401584 | A | 7/1975 |
| JP | 52-39277 | A | 3/1977 |
| JP | 52-41384 | A | 3/1977 |
| JP | 55-033777 | | 3/1980 |
| JP | 1-320400 | | 12/1989 |
| JP | 4-312296 | A | 11/1992 |
| JP | 6-294497 | A | 10/1994 |
| JP | 2000-503108 | | 3/2000 |
| JP | 2002-274493 | A | 9/2002 |
| JP | 2005-146856 | | 6/2005 |
| JP | 2009-030675 | A | 2/2009 |
| WO | WO-98/43029 | | 10/1998 |

OTHER PUBLICATIONS

Non-Final Office Action received for U.S. Appl. No. 13/143,023, dated Jun. 12, 2014, 8 pages.
Non-Final Office Action received for U.S. Appl. No. 13/143,023, dated May 6, 2015, 10 pages.
Norwegian Search Report received for Norwegian Patent Application No. 20092477, dated Jan. 29, 2010, 2 pages (with English Translation).
Office Action received for Chinese Patent Application No. 201080005936.3, dated Jun. 26, 2013, 12 pages (English Translation only).
Office Action received for Japanese Patent Application No. 2011-553970, dated Feb. 5, 2013, 4 pages (English Translation only).
Restriction requirement received for U.S. Appl. No. 13/143,023, dated Mar. 14, 2014, 8 pages.
International Search Report and Written Opinion received for PCT Patent Application No. PCT/NO2010/000166, dated Oct. 13, 2010, 9 pages.
International Preliminary Report on Patentability received for PCT Patent Application No. PCT/NO2010/000166, dated Jan. 12, 2012, 7 pages.
Office Action received for Chinese Patent Application No. 201510259940.7, dated Jun. 24, 2016, 3 pages of English Translation.
Notice of Reasons for Rejection dated Jan. 10, 2017, directed to JP Application No. 2016-050614; 8 pages.
Notice of Allowance received for U.S. Appl. No. 15/084,318, dated Jul. 17, 2017, 8 pages.
Decision of Rejection received for Japanese Patent Application No. 2016-050614, dated Jul. 3, 2017, 6 pages (3 pages of English translation and 3 pages of Official copy).
Extended European Search Report (includes Supplementary European Search Report and Search Opinion) received for European Patent Application No. 10794406.8, dated Oct. 18, 2017, 8 pages.
Notice of Allowance received for U.S. Appl. No. 13/143,023, dated Feb. 5, 2018, 4 pages.
Notice of Allowance received for U.S. Appl. No. 13/143,023, dated Jan. 31, 2018, 7 pages.

* cited by examiner

METHOD AND SYSTEM FOR STORAGE AND TRANSPORT OF LIQUEFIED PETROLEUM GASES

REFERENCE TO RELATED APPLICATION

This application is a divisional of U.S. patent application Ser. No. 13/143,023, filed Sep. 28, 2011, which is a U.S. National Stage patent application of PCT/NO2010/000166, filed May 3, 2010, which claims priority to Norwegian Patent Application No. 20092477, filed Jun. 30, 2009, each of which is hereby incorporated by reference in the present disclosure in its entirety.

FIELD OF THE INVENTION

The invention concerns a method and system for storage and transport of liquefied petroleum gases, normally known as LPG, on a tanker vessel, hereinafter referred to as LPG carriers, and particularly the transport of two cargoes on the same shipment.

BACKGROUND OF THE INVENTION

Further, the present method and system are equally applicable for the use on floating production storage and Offloading vessels for liquefied petroleum gases, LPG FPSO, and similarly the use on floating storage and offloading vessels for liquefied petroleum gases, LPG FSO.

The term LPG carriers defined above shall hereinafter also include both LPG FPSO's and LPG FSO's.

SUMMARY OF THE INVENTION

LPG is to be understood as a range of different grades or products of petroleum gases stored and transported as liquid. Of the various petroleum gases propane and butane are the principal examples in which propane typically includes any concentration of ethane from 0% up to 5% and butane can be any mixture of normal-butane and iso-butane. In addition LPG should as a minimum include:

ammonia
butadiene
butane-propane mixture (any mixture)
butylenes
diethyl ether
propylene
vinyl chloride LPG's are transported in liquid form either at pressures greater than atmospheric or at temperatures below ambient, or a combination of both. This invention relates to:

(1) LPG carriers transporting liquefied cargoes, LPG, at temperatures below ambient, known as fully refrigerated LPG carriers, and
(2) LPG carriers transporting liquefied cargoes, LPG, at pressures greater than atmospheric and temperatures below ambient. The latter is known as semi-refrigrated/semi-pressurized.

LPG stored and transported at temperatures below ambient releases continuously a certain amount of vapor. The normal manner of maintaining the pressure in the cargo tanks is to extract the released vapor, then being liquefied and returned back to the cargo tanks as condensate.

Hereinafter, condensate is to be understood as liquefied vapor whereas vapor is meant to be the product of vapors consisting of vapors generated by heat input to the LPG and any vapor generated when the condensate is returned.

A cargo type is any of the LPG grades or products mentioned above. As an example first cargo type and second cargo type could be propane and butane, respectively.

In this description, a reliquefaction unit is hereinafter meant to be a refrigeration unit which duty is to liquefy vapor and the prefix "re" points to liquefaction of vapor from liquefied gases. A cargo tank is one or more liquid tight containers intended to hold LPG. Standby operation is using, for instance, a unit ready to be used when needed.

Normally, one to two cargoes are carried per shipment. Amongst the different types of LPG cargoes, the products can typically be propane and butane. The latter are segregated into dedicated cargo tanks and all cargo handling is handled in a manner without mixing liquid and vapor from the two cargoes. This includes segregated operations at least for the following cargo handling operations:

maintaining cargo tank pressures and temperatures for two segregated cargoes;
cooling down the cargos during voyage; and
cooling down the cargos under loading.

Typically, the previously known LPG carriers capable of handling two cargoes have three to four reliquefaction units installed to handle vapor from the two cargoes simultaneously.

One size type of LPG carriers, the very large gas carriers, VLGC, have typically installed four identical reliquefaction units. Whilst a second size type LPG carrier, the medium size gas carrier, MSGC, have typically installed three identical reliquefaction units. In both cases, the reliquefaction units are fully independent of one another and are of the type being totally refrigerated.

A typical operational modus for a VLGC carrying two LPG cargoes, such as e.g. propane and butane, has two reliquefaction units handling propane vapor, one reliquefaction unit handling butane vapor, and one reliquefaction unit is in standby. For an MSGC carrying propane and butane, for instance, one reliquefaction unit is typically handling propane vapor, one reliquefaction unit butane vapor, and one reliquefaction in standby, respectively.

For reference and illustration, FIGS. 1 and 2 shows a typical reliquefaction unit and typical arrangement for a VLGC carrying two cargoes, respectively, of which a first cargo type typically could be propane and the second cargo type butane.

As illustrated in FIG. 2 vapor that evaporates in at least one cargo tank from a first cargo type flows via a line 1 and distributes to separate lines 2, 3 before flowing to two separate reliquefaction units, in which the vapor is condensed and returned back to cargo tank 100 via a line 6. Vapor that evaporates in at least one further cargo tank from a second cargo type flows via the line 7 to yet another reliquefaction unit, in which the vapor is condensed and returned back to the cargo tank via the line 8.

Each reliquefaction unit comprises typically minimum one compressor 1.100, 1.200, see FIG. 1, taking suction from the vapor line connected to the cargo tank, compressing the vapor, condensing it against a cold medium 1.300, such as e.g. sea water, or a refrigerant provided by a secondary system. The vapor flow from the cargo tank is controlled by the operation of the compressor. One reliquefaction unit is typically in standby operation.

Example

A typical VLGC with four liquid tight containers A to D is designed for carrying a number of different cargoes of which the coldest cargo to be considered is propane. The calculated heat leakage into the cargo arrangement totals to e.g. 427 kW and, then, the heat leakage into each cargo tank arrangement is:

Liquid tight container A: 96 kW
Liquid tight container B: 112 kW
Liquid tight container C: 112 kW
Liquid tight container D: 107 kW Cargo tank arrangement is to be understood as the cargo tank and all associated piping and equipment external to the liquid tight containers.

Total installed refrigerant capacity shall thus not be less than 427 kW plus sufficient redundancy to meet the requirements set forth by international classification societies and the International Code for the Construction and Equipment of Ships Carrying Liquefied Gases in Bulk, the IGC Code. Based on operational issues the ship owners have typically additional requirements for further increased refrigerant capacity.

As a consequence a VLGC is typically equipped with four reliquefaction units, each unit normally with a reliquefaction capacity above 220 kW. Typically, each unit is capable of handling 2230 kg propane vapor per hour. Total evaporation from a VLGC carrying only propane typically amount to 3890 kg/hr. Capacities are naturally a function of ambient temperatures and type of cargo and change accordingly.

For the same VLGC carrying iso-butane the total heat leakage is 240 kW and each reliquefaction unit has a reliquefaction capacity of typically 340 kW. Total evaporation from a VLGC carrying only iso-butane typically amount to 1350 kg/hr.

When the VLGC carries both of the above cargoes a segregated operation applies. Assuming iso-butane loaded in liquid tight container A & B and propane loaded in liquid tight container C & D, the vapor flow of propane and iso-butane is approximately 1895 kg/hr and 690 kg/hr, respectively. For such a scenario, two reliquefaction units are in operation, one for propane and one for iso-butane. If the LPG carrier has propane in three cargo tanks, three reliquefaction units are in operation, two for propane and one for iso-butane.

Due to excessive capacity for each of the reliquefaction units in operation, operation of these units are normally intermittent, e.g. 12 hours operation 12 hours standby.

Thus, the main object of the present invention is to propose a simplified solution minimizing the number of reliquefaction units needed to take properly care of all vapors of the different cargo types.

This is according to one aspect the invention achieved by a method for storage and transport of LPG on LPG carriers, in particular two cargoes of different LPG types on same shipment, having reliquefaction units in which vaporized gases are condensed and then returned into at least one cargo tank for the respective LPG cargo type, comprising:

- using the reliquefaction units, at a minimum one running, so as to condense vapor from the first cargo type;
- passing the condensed vapor through a heat exchanger;
- simultaneously flowing vapor from the second cargo type through the heat exchanger so as to condense the vapor by means of heat exchanging with the condensed vapor; and
- returning the condensed vapors leaving the heat exchanger back into the respective cargo types.

Moreover, the invention relates to a system for storage and transport of LPG on LPG carriers, in particular two cargoes of different LPG types on same shipment, having reliquefaction units in which vaporized gases are condensed and then returned into at least one cargo tank for the respective LPG cargo type, wherein:

- the reliquefaction units, at a minimum one running, is used to condense vapor from the first cargo type;
- the condensed vapor is passed through a heat exchanger;
- vapor from the second cargo type is simultaneously flowed through the heat exchanger to condense the vapor by means of heat exchanging with the condensed vapor; and
- the condensed vapors leaving the heat exchanger is returned back into the respective cargo types.

Some of the benefits by the proposed method and system are that the number of running reliquefaction is reduced to a minimum of one unit and that condensed vapor leaving the running reliquefaction unit can be used as a refrigerant in the heat exchanger.

To meet the pressure in the respective cargo tank for the first cargo type, the condensed vapor from the reliquefaction unit can be throttled upstream or downstream of the heat exchanger. The throttling can alternatively be performed in two stages.

The heat exchanger can be installed on a high point location on the LPG carrier so as to allow the condensed vapors to freely flow back into the cargo tanks. However, if free flow back to a respective cargo tank for the second cargo type is impeded, the condensed vapor to be returned into the second cargo type could be pumped.

To provide an elevated condensation pressure and, thus, allow for a more flexible location of the heat exchanger, vapor of the second cargo type can be compressed upstream of the heat exchanger.

The condensed vapor of the first cargo type can be returned from the heat exchanger through a separator so as to separate vapor and liquid phase, and liquid returned back into the first cargo type. To provide for a higher inlet pressure at the running reliquefaction unit, separated vapor can be passed through an ejector.

To minimize running time on machinery, a reciprocating compressor in the reliquefaction units is operated by means of an electric motor and, when allowable, speeding up the motor above normal so as to use the power potential thereof.

BRIEF DESCRIPTION OF THE DRAWINGS

The present invention is discussed below with reference to preferred embodiments presented in the accompanying drawings, in which.

DETAILED DESCRIPTION OF THE INVENTION

Figure 3:
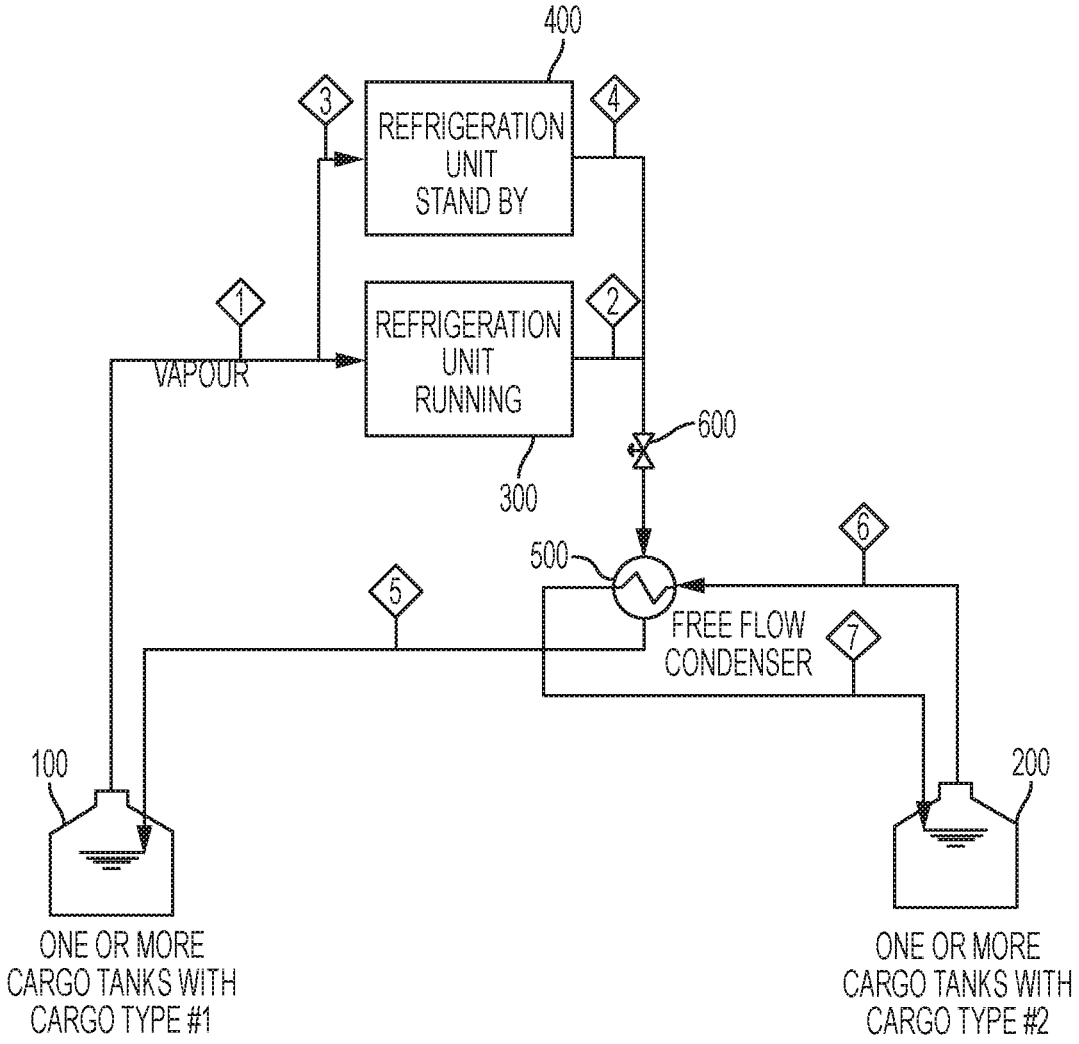
FIG. 3 schematically shows an embodiment having two reliquefaction units, of which one is running and the other is in standby.

As mentioned above and illustrated in FIG. 3, for instance, the invention relates to a method and system for transporting and storing liquefied petroleum gases, in particularly two grades of products, on the same shipment. This allows for a reduced number of installed reliquefaction units compared to "Prior Art" all down to a minimum of two units including one running unit and is still providing the required redundancy set forth by international classification societies and the IGC Code. Ship owners additional requirements on refrigeration duty is also covered. During normal operations one out of the two units is in standby operations.

Although the reduced number has a minimum of two reliquefaction units, other options is possible For instance, one reliquefaction unit with redundant rotating machinery could be used. Other configurations are also applicable, e.g. having three units.

Note that the type of reliquefaction unit is not crucial when utilizing the invention. However, for convenience it is assumed same type of reliquefaction unit corresponding to the prior art but with typically twice the capacity.

Vapor that evaporates from the first cargo type contained in one or more cargo tanks 100 flows via a line 1 to the reliquefaction unit 300 to be condensed and, thereafter, returned via a line 5. Condensate flows from the reliquefaction unit 300 via a throttle valve 600, in which the pressure is reduced to meet the pressure in the cargo tank(s) 100. After throttling, the condensate or, depending on the process conditions of the reliquefaction plant, the mixed phase fluid enters a heat exchanger 500, in which the condensate is used as the heat sink. At exit of the heat exchanger 500, the condensate leaves in the form of a mixed phase fluid and flows back to the cargo tank(s) 100. The heat exchanger 500 is preferably a free flow condenser.

Although, only one heat exchanger is shown in the drawings, it should be understood that more heat exchanger 500 could be installed. In such an instance the condensed vapor from the reliquefaction unit 300 is divided in an appropriate manner and passed through the respective heat exchangers.

Vapor that evaporates from the second cargo type contained in at least one cargo tank 200 flows via a line 6 to the heat exchanger 500 and the vapor is condensed and returned back to the cargo tank(s) 200 via a line 7. The vapor flow is by means of natural circulation. No compressors or other mechanical means are needed, such as e.g. an ejector, to propel the vapor from cargo tank 200 into heat exchanger 500 to be condensed and returned.

The refrigerant duty required to condense all vapor associated with the second cargo type is taken from the available spare refrigerant capacity of the reliquefaction unit handling all vapor associated with the first cargo type. Condensate from the refrigeration unit 300 is thus used as a refrigerant in the heat exchanger 500 to condense the vapor from the second cargo type.

The heat exchanger 500 is preferably installed on a high point location on the LPG carrier allowing the condensed vapor to freely flow back to the cargo tanks 100, 200. A high point location can be on top of the cargo compressor room, on the pipe rack running along the LPG carrier, on a high point on any existing deck module or on a dedicated high point structure.

Handling of all associated vapor from the first cargo type is in principle identical to the "Prior Art" but differs with respect to the increased vapor flow rate caused by the fact that the condensate returned to the tank(s) 100 is first used to condense all associated vapor from the second cargo type before returned to the cargo tank(s) 100. The net condensate returned to the first cargo type in the cargo tank(s) 100 corresponds to the net evaporated cargo vapor being evaporation caused by heat added to the cargo tank(s) 100.

The function according to the invention is based on the fact that each reliquefaction unit is designed for handling a ship being fully loaded with its coldest design cargo, typically propane and when some of this cargo capacity is taken up by a warmer cargo, e.g. butane, it is available an excessive refrigeration capacity that can be used to condense the warmer part cargo.

The excessive refrigeration capacity is utilized by transferring heat added to the warmer cargo side into the colder cargo side and, thus, circulating a higher cold vapor flow than if two segregated arrangements are in operation.

The present example illustrates the operations for a LPG carrier loaded with two grades on board a VLGC. Iso-butane is loaded in two cargo tanks, tank A & B, and propane is loaded in two other cargo tanks, tank C & D.

Approximately 690 kg/hr of iso-butane flows naturally towards heat exchanger 500 and typically enters the heat exchanger at a temperature of −3° C. The total refrigerant duty required to cool and condense this flow of iso-butane is about 7/kW. The total refrigerant duty required to cool and condense the propane flow is about 219 kW. One reliquefaction unit has a total refrigeration capacity of 427 kW.

Other sizes of reliquefaction units occur for other sizes of LPG carriers.

Figure 4:
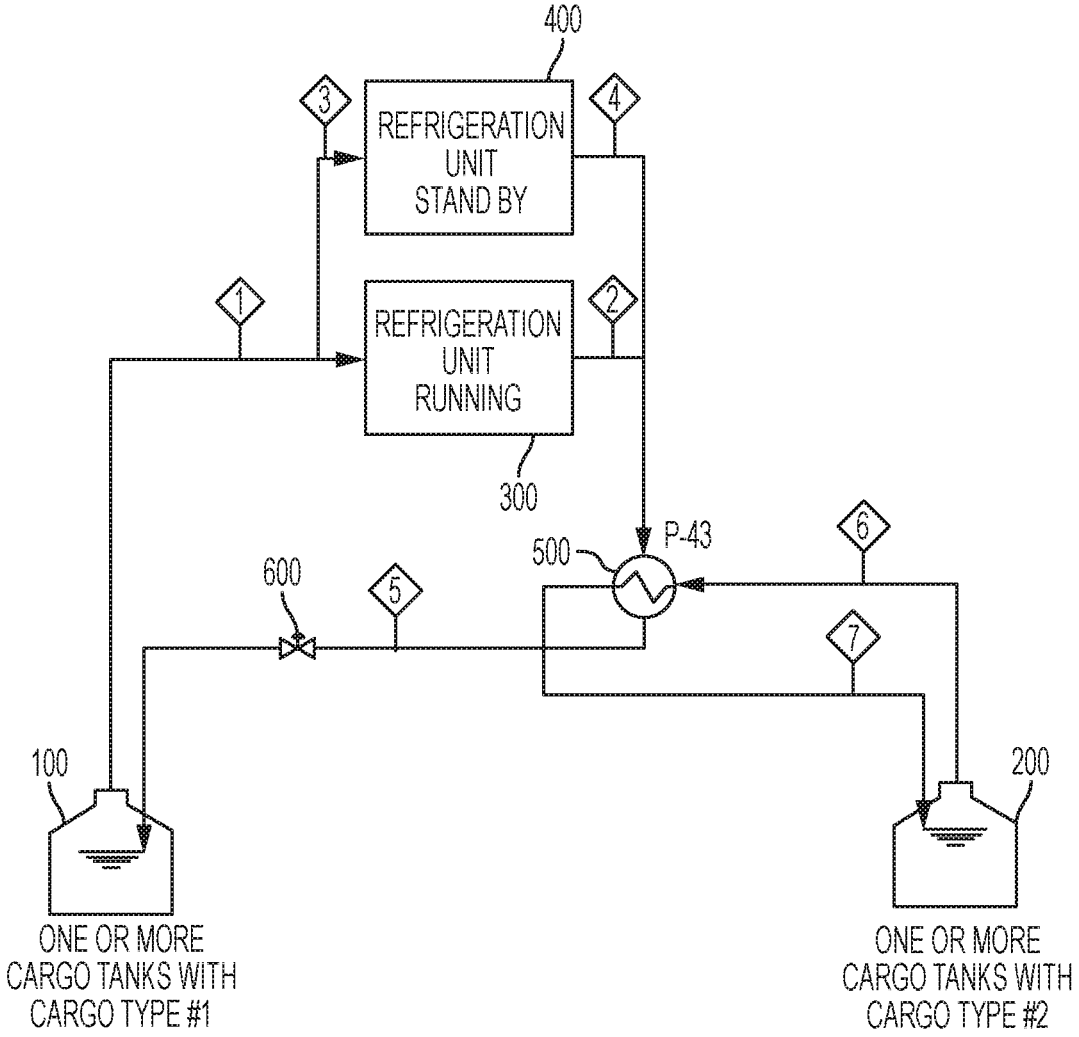
FIG. 4 schematically shows another embodiment corresponding to FIG. 3, except that a throttle is arranged downstream of a heat exchanger.

As depicted in FIG. 4, the throttle valve 600 is alternatively located downstream of heat exchanger 500.

Figure 5:
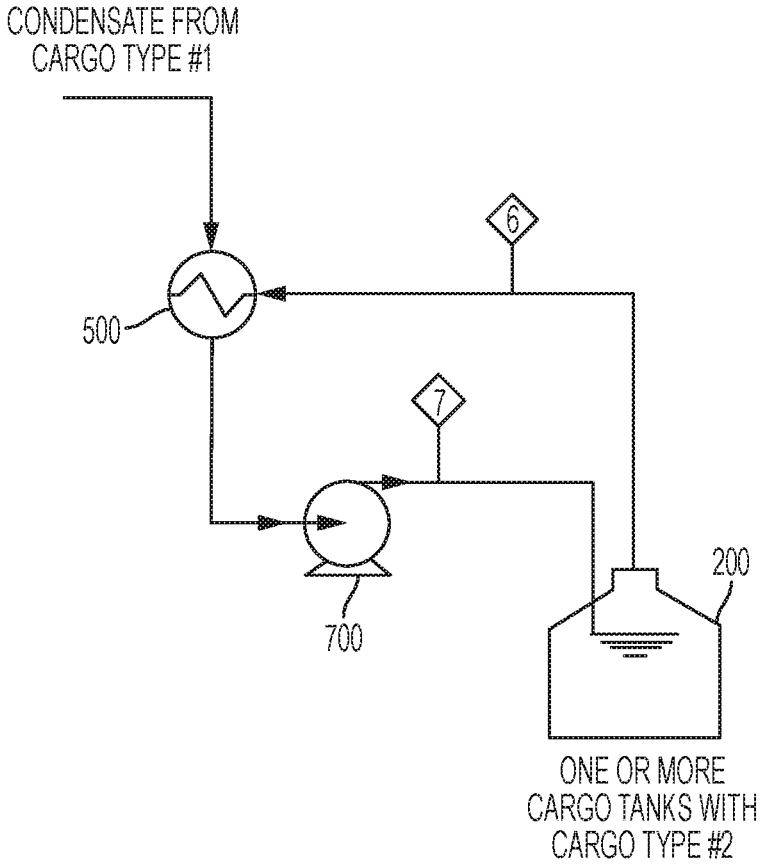
FIG. 5 schematically shows an out cut of the embodiments in FIGS. 3 and 4, respectively, and including a pump downstream of the heat exchanger.

When needed, the heat exchanger 500 can alternatively be located at a lower elevation than the piping running back to the cargo tanks 100, 200 but, then, a circulation pump 700 must be installed, see FIG. 5 not showing the correct location of the heat exchanger relatively to the piping.

Figure 6:
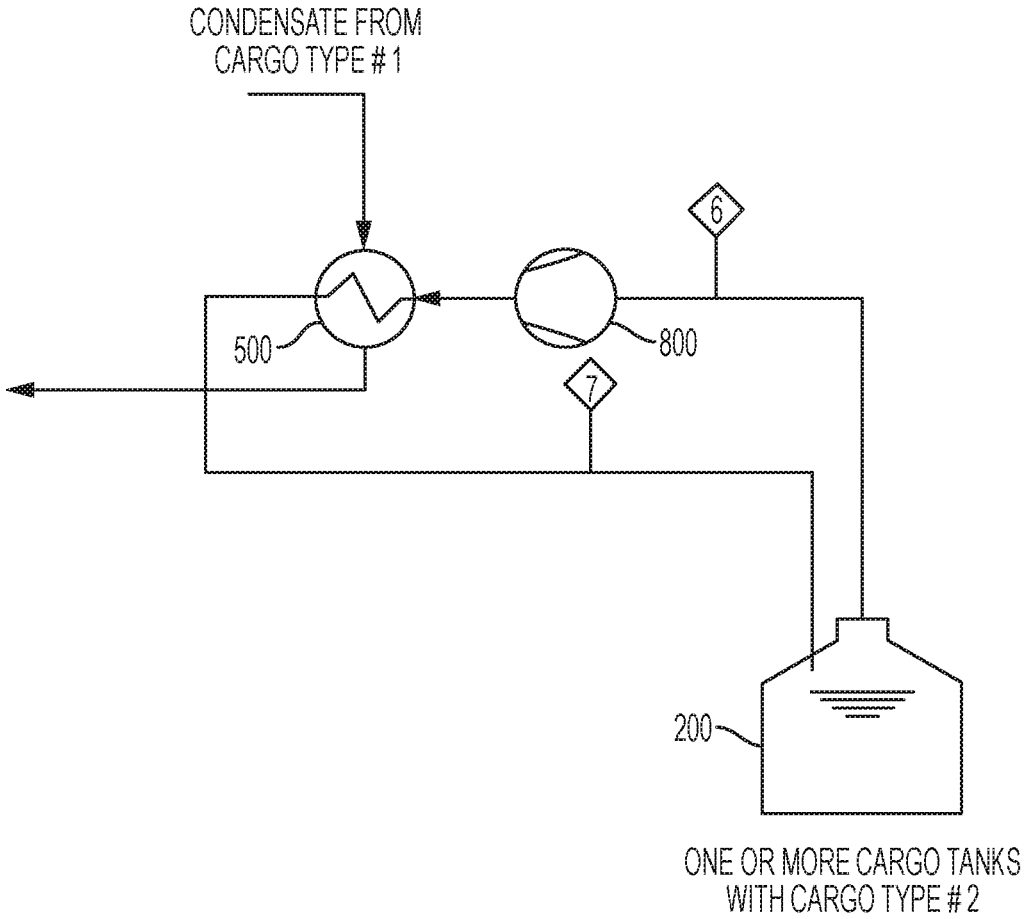
FIG. 6 schematically shows an out cut of the embodiments in FIGS. 3 and 4, respectively, and including a compressor upstream of the heat exchanger.

Alternatively, a small blower or compressor 800 can be installed upstream of heat exchanger 500 providing a slightly elevated condensation pressure and thus also allowing for a more flexible location of heat exchanger 500, see FIG. 6.

Figure 7:
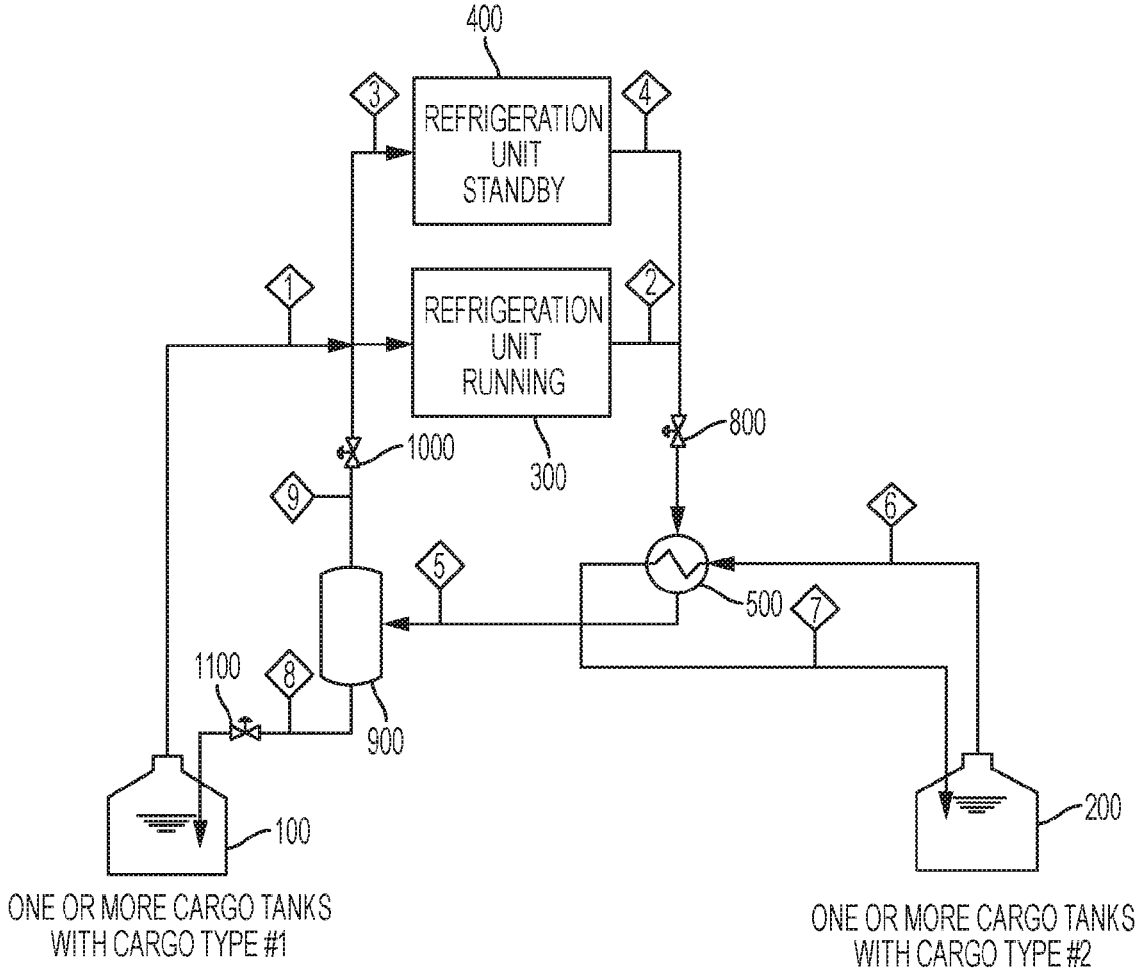
FIG. 7 schematically shows an embodiment similar to FIG. 3 but including a separator downstream of the heat exchanger.

As shown in FIG. 7 the mixed phase fluid leaving the heat exchanger 500 via the line 5 enters a separator 900, in which the vapor and liquid phases are separated. Liquid leaves via a line 8 and is introduced back into the first cargo type in the cargo tank(s) 100. Vapor leaves via a line 9 and is mixed with vapor flowing in line the 1. By this arrangement, the required vapor handling capacity of each liquid tight container and associated piping is reduced.

To minimize running time on machinery the reliquefaction units are operated intermittently. This is done by allowing the pressure in the cargo tanks to increase to a high level, then start the reliquefaction units and reduce the pressure in the cargo tanks. Actual running time is governed by several factors as e.g. ambient temperatures, amount of volatile components in the cargo and sea conditions. Volatile components in the LPG are typically ethane and normally varied between 0 and 5 mol %. Higher concentrations of ethane may occasionally occur.

Figure 1:
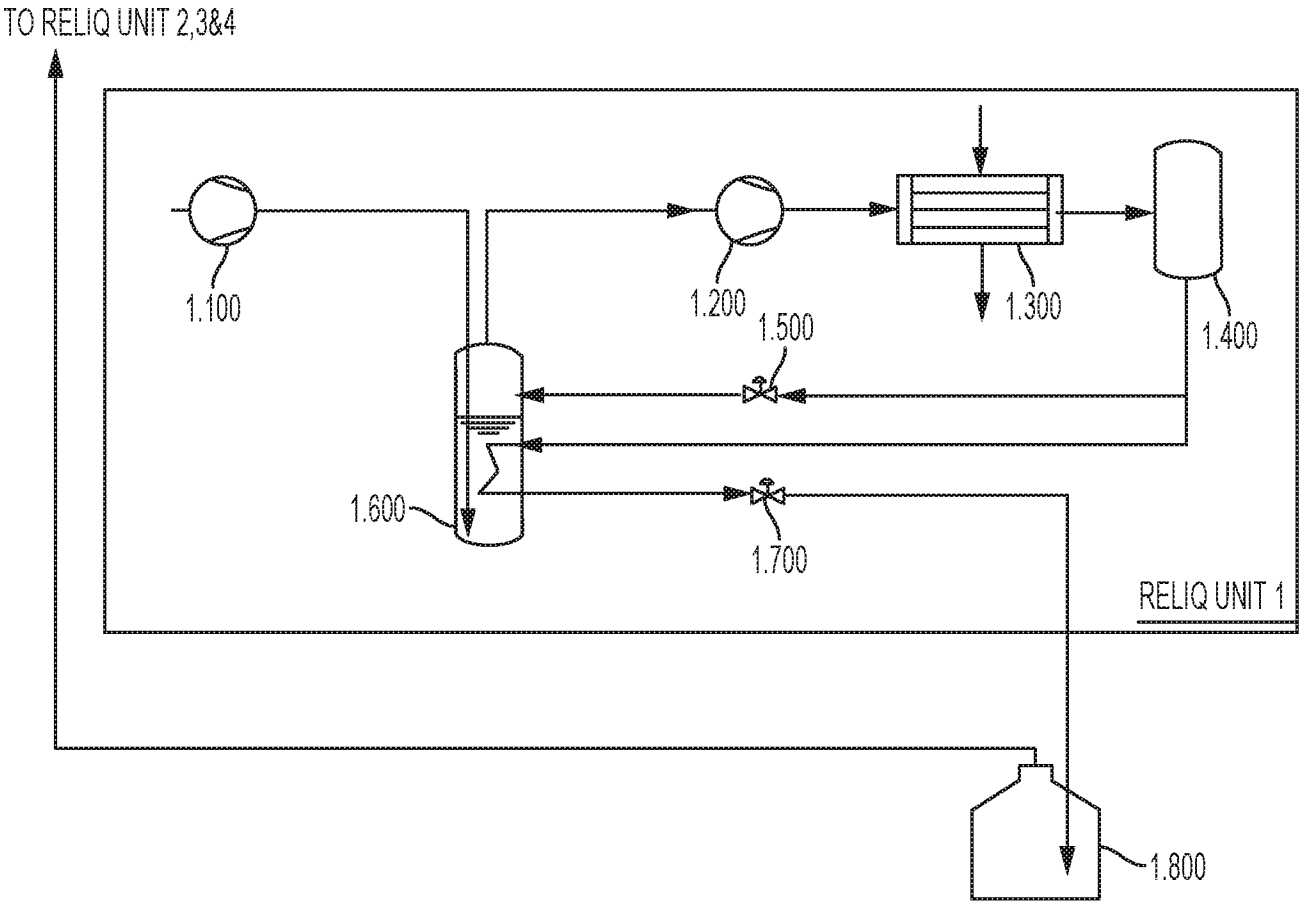
FIGS. 1 and 2 schematically show a typical prior art reliquefaction unit and typical arrangement for a VLGC carrying two cargoes, respectively.
Figure 2:
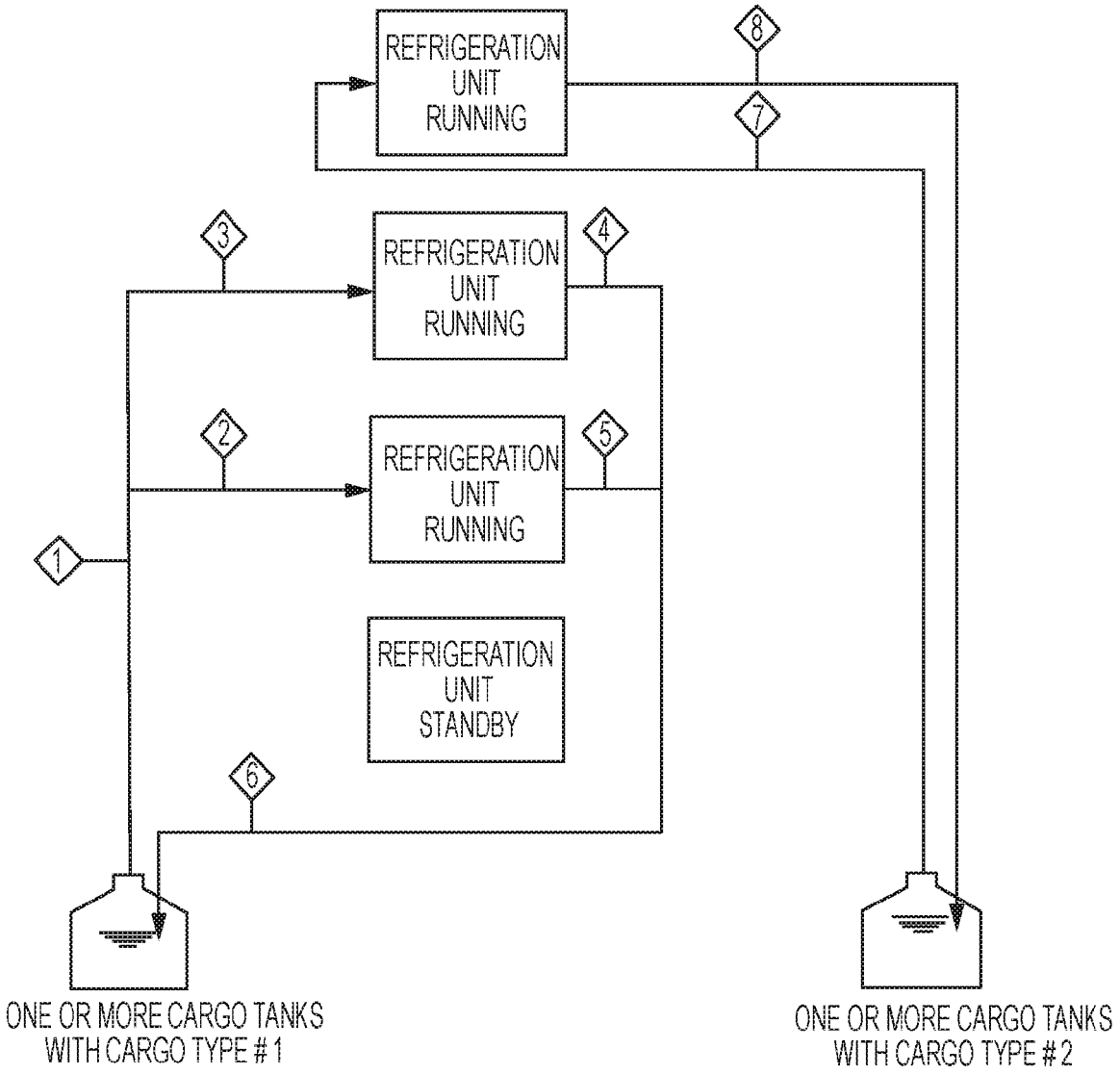
Figure 8:
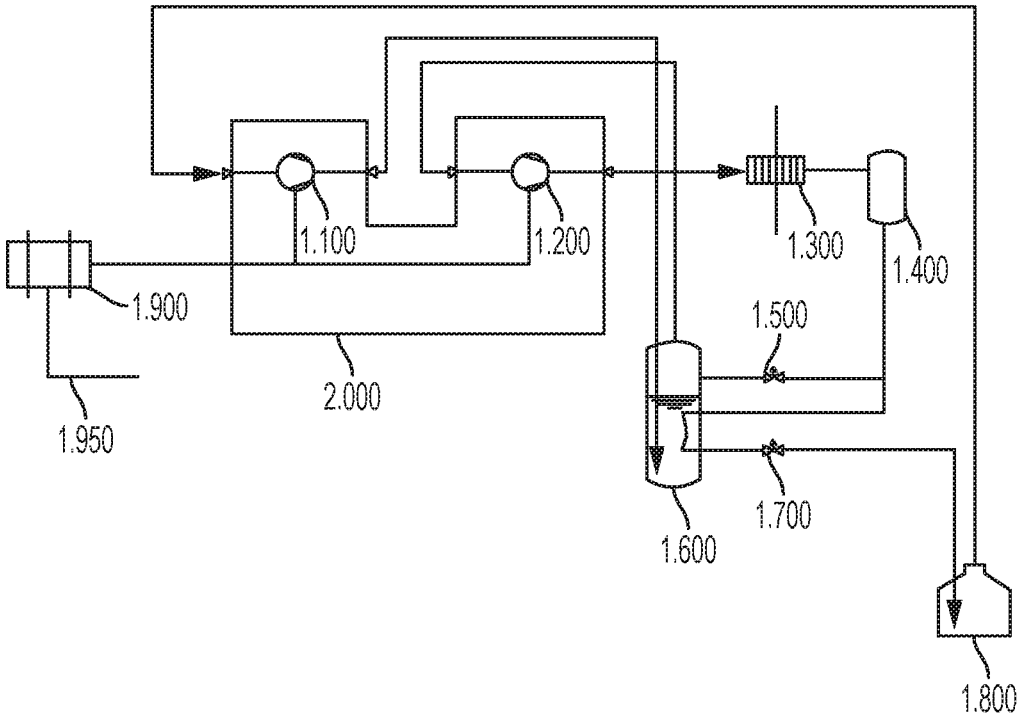
FIG. 8 schematically shows an embodiment in which running time by intermittently operating the reliquefaction unit based on pressure increase in the cargo tanks.

The compressor 1.100 and 1.200 shown in FIG. 1 is commonly two compression stages of one large reciprocating compressor 2.000, see FIG. 8. More than two compression stages are also common, not shown. An electric motor 1.900 drives the compressor.

A reciprocating compressor is a positive displacement compressor where for a given compressor its volumetric capacity is given by its design and thus operates at its maximum volumetric capacity at any given time. Since not only running time but also the compression work is governed by conditions as ambient temperatures and amount of volatile components in the gas to be compressed the electric motor 1.900 does not necessarily run on its maximum continuous rating.

To utilize the power potential of the electric motor it is proposed to speed up the motor rpm above normal rpm when conditions described above allows for it, this will be done by increasing the frequency of the power supply 1.950 to frequencies above normal. The volumetric capacity of a displacement compressor increases proportionally with speed and hence the refrigerant capacity also increases and thus running time reduces.

The invention claimed is:

1. A method for storage and transport of liquefied petroleum gas (LPG) on LPG carriers, including two cargoes of different LPG types on same shipment, having reliquefaction units in which vaporized gases are condensed and then returned into at least one cargo tank for the respective LPG cargo type, the method comprising:

using the reliquefaction units containing a first refrigerant, at a minimum one running, so as to condense vapor from a first one of the two cargo types (first LPG type) to yield a first condensed vapor using the first refrigerant;

passing the first condensed vapor through a heat exchanger;

simultaneously flowing vapor from a second one of the two cargo types (second LPG type) through the heat exchanger so as to condense the vapor from the second LPG type to yield a second condensed vapor using the first condensed vapor as a second refrigerant;

returning the first and second condensed vapors leaving the heat exchanger back into the respective cargo types; and throttling the first condensed vapor from the reliquefaction units upstream or downstream of the heat exchanger as to meet pressure requirements, wherein the first refrigerant, the first LPG type, and the second LPG type are separate from each other and have different flow paths.

2. The method according to claim 1, further comprising: throttling the condensed vapor in two stages as to meet the pressure requirements.

3. A system for storage and transport of liquefied petroleum gas (LPG) on LPG carriers, including two cargoes of different LPG types on same shipment, having reliquefaction units in which vaporized gases are condensed and then returned into at least one cargo tank for the respective LPG cargo type, comprising:

reliquefaction units containing a first refrigerant and configured, at a minimum one running, to condense first vapor from a first one of the two cargo types (first LPG type) using the first refrigerant;

a heat exchanger configured to let the first condensed vapor pass therethrough;

the heat exchanger being further configured to allow vapor from a second one of the two cargo types (second LPG type) to simultaneously flow therethrough to condense the vapor from the second LPG type to yield a second condensed vapor using the first condensed vapor as a second refrigerant;

the heat exchanger having an outlet enabling the first and second condensed vapors leaving the heat exchanger to return back into the respective cargo types;

the first condensed vapor from the reliquefaction units being throttled using a throttle valve arranged in flow lines upstream or downstream of the heat exchanger, respectively, and the first refrigerant, the first LPG type, and the second LPG type being separate from each other and having different flow paths.

4. The system according to claim 3, wherein the first condensed vapor from the reliquefaction units is throttled in two stages.

* * * * *